United States Patent [19]

Floyd et al.

[11] Patent Number: 4,735,739

[45] Date of Patent: Apr. 5, 1988

[54] SUSTAINED DETERGENT RELEASE WASH WIPE

[75] Inventors: David T. Floyd; Gary L. Shanklin, both of Appleton, Wis.

[73] Assignee: Kimberly-Clark Corporation, Neenah, Wis.

[21] Appl. No.: 899,118

[22] Filed: Aug. 22, 1986

[51] Int. Cl.[4] ..... C11D 17/04; C11D 1/29

[52] U.S. Cl. ..... 252/91; 15/104.93; 252/548; 252/550; 252/551; 252/553; 252/555; 252/558

[58] Field of Search ..... 252/91, 548, 550, 551, 252/555, 558; 15/104.93; 428/288, 289

[56] References Cited

U.S. PATENT DOCUMENTS

| | | | |
|---|---|---|---|
| 3,115,425 | 12/1963 | Zmoda | 134/6 |
| 3,598,742 | 8/1971 | Jamison et al. | 252/91 |
| 3,788,999 | 1/1974 | Abler | 252/91 |
| 4,189,395 | 2/1980 | Bland | 252/91 |
| 4,307,143 | 12/1981 | Meitner | 252/91 |
| 4,328,279 | 5/1982 | Meitner et al. | 428/289 |
| 4,515,703 | 5/1985 | Hag | 252/92 |
| 4,624,890 | 11/1986 | Lloyd et al. | 428/290 |

FOREIGN PATENT DOCUMENTS

| | | | |
|---|---|---|---|
| 2460239 | 7/1975 | Fed. Rep. of Germany | 252/91 |

*Primary Examiner*—Prince E. Willis

*Attorney, Agent, or Firm*—Gregory E. Croft; Donald L. Traut; Jeremiah J. Duggan

[57] ABSTRACT

A polyolefin wash wipe containing a detergent and a long chain alkanolamide exhibits significant sustained time release of detergent, thereby enabling the user to repeatedly rinse the wipe while still retaining detergent for cleaning.

11 Claims, No Drawings

SUSTAINED DETERGENT RELEASE WASH WIPE

BACKGROND OF THE INVENTION

In the automotive industry a wide variety of automobile cleaning products is available. One such product is a detergent-containing wash wipe for washing cars. In using this product, the user wets the wash wipe to release the detergent while wiping the car. As the wipe gets dirty, it is repeatedly rinsed with water until it no longer releases detergent. Although the concept of a wash wipe containing its own detergent is a good one for convenience to the consumer, a drawback is the necessity of having to use more than one such wipe to wash a full-sized car. This drawback is due to the fact that the detergent is released too quickly from the wipe when it is rinsed with water. The result is that a large amount of detergent is initially available for washing, but the amount of detergent remaining after one or two rinses is insufficient.

Therefore there is a need for a detergent-containing wash wipe in which the release of detergent is sustained over a longer period of time, thereby allowing a single wipe to be used to wash a full-sized car.

SUMMARY OF THE INVENTION

In one aspect, the invention resides in a wash wipe comprising a nonwoven polyolefin web containing a water-soluble detergent composition which has an affinity for the polyolefin web. This affinity for the polyolefin web causes the detergent to be slowly released over a sustained period of time sufficient to wash a full-sized car.

The web can be any woven or nonwoven web containing a substantial amount of polyolefin. Preferably the web is a meltblown polypropylene or polyethylene web. Such a web is available commercially from Kimberly-Clark Corporation, Roswell, Georgia. The basis weight of the web can be from 40 to about 140 grams per square meter, preferably about 80 grams per square meter for a polypropylene meltblown web. The size of the web is preferably about 19 inches $\times$19 inches for wiping convenience and efficiency.

The essential ingredient of the detergent composition which imparts the polyolefin affinity and sustained time release property is a long chain alkanolamide having either of the following general formulae:

$$CH_3(CH_2)_nC(=O)-X$$

or $$CH_3(CH_2)_7CH{=}CH(CH_2)_7C(=O)-X$$

wherein "n" is an integer of from 10 to 16 and "X" is $$N(CH_2CH_2OH)_2,\ NHCH_2CH_2OH \text{ or } NHCH_2CH(CH_3)OH.$$

Suitable long chain alkanolamides include, but are not limited to, monoethanolamides of coconut acid, diethanolamides of lauric acid, diethanolamides of coconut acid, diethanolamides of oleic acid, and monoisopropanolamides of oleic acid. An important characteristic of the long chain alkanolamides of this invention, for purposes of consumer acceptance, is that it be of the type that dries to a powder or wax rather than feeling wet.

The long chain alkanolamide is the reaction product of an alkene oxide amide with a fatty acid. Suitable alkene oxide amides include those having either 2 or 3 carbon atoms. Ethylene oxide amides are preferred. Suitable fatty acids include those having a chain length of from 12 to 18. Preferred fatty acids include lauric, oleic, stearic, and palmitic acid. The mole ratio of alkene oxide amide to fatty acid can be from about 2:1 to 1:1, preferably about 1:1. A preferred long chain alkanolamide is synthesized from lauric acid and ethylene oxide amide and has the formula:

$$CH_3(CH_2)_{10}C(=O)N(CH_2CH_2OH)_2$$

It will be appreciated, however, that the formula of the long chain alkanolamide is a general formula representing a mixture of alkanolamides caused by impurities of varying carbon chain lengths found in the fatty acids used to synthesize the long chain alkanolamides.

The balance of the detergent composition includes at least one primary detergent, which can be any water soluble detergent(s) well known in the art. Suitable primary detergents include fatty alcohol sulfates of the formula:

$$CH_3(CH_2)_nCH_2OSO_3-X$$

wherein "n" is an integer of from 7 to 18 and "X" is $NH_4$, Na, $HN(CH_2CH_2OH)_3$, $HNH(CH_2CH_2OH)_2$, or $HNH_2CH_2CH_2OH$.

Other suitable primary detergents include alkyl aryl sulfonates of the formula:

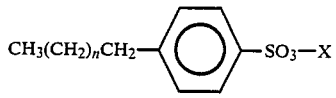

wherein "n" is an integer of from 8 to 10 and "X" is $NH_4$, Na, $HN(CH_2CH_2OH)_3$, or $HNH(CH_2CH_2OH)_2$. Preferred examples of primary detergents include sodium salts of $C_{14}$–$C_{16}$ olefin sulfonates, triethanolamine salt of lauryl sulfate, sodium salt of cetyl sulfate, sodium salt of lauryl sulfate, ammonium salt of lauryl sulfate, and sodium salt of dodecylbenzene sulfonate.

Preferably, the detergent composition also contains a flash foaming agent to provide suds when the product is being used. Flash foaming agents are detergents in themselves and, for purposes herein, are included in the term "detergent" unless the detergent is referred to as a "primary" detergent. Suitable flash foaming agents include ethoxylated fatty alcohol sulfates having the formula:

$$CH_3(CH_2)_n(OCH_2CH_2)_yOSO_3-X$$

wherein "n" is an integer of from 7 to 18, "y" is an integer of from 1 to 14, and "X" is $NH_4$, Na, $HN(CH_2CH_2OH)_3$, $HNH(CH_2CH_2OH)_2$, or $HNH_2CH_2CH_2OH$. Preferred flash foaming agents include the ammonium salt of 2 mole ethoxylated lauryl alcohol sulfate, the sodium salt of 1 mole ethoxylated lauryl alcohol sulfate, the sodium salt of 3–4 mole ethoxylated lauryl alcohol sulfate, and the sodium salt of 7 mole ethoxylated lauryl alcohol sulfate.

The mole ratio of primary detergent to flash foaming agent can suitably be from about 20:1 to 1:1, preferably from about 12:1 to 8:1.

The mole ratio of detergent to alkanolamide can be from about 10:1 to 1:1, preferably from about 6:1 to 2:1.

The detergent composition, which includes the long chain alkanolamide, is applied to the polyolefin web at a solids add-on of from about 20 to about 100 weight percent based on the dry weight of the web. This add-on provides at least about 8 grams of detergent for a 19"×19" wash wipe. For any product, at least about 5 grams of detergent is necessary to wash a car. The add-on of detergent can readily be accomplished by dipping or soaking the web in the detergent solution and drying the web. Complete saturation of the web is not necessary, but desirable in order to obtain the maximum detergent add-on.

A preferred wash wipe comprises a polypropylene meltblown web having a basis weight of about 80 grams per square meter and a water-soluble detergent composition, said detergent composition comprising about 55 weight percent of the sodium salt of $C_{14}$–$C_{16}$ olefin sulfonates (primary detergent), about 5 weight percent of the sodium salt of ethoxylated lauryl alcohol sulfate (flash foaming agent), and about 40 weight percent diethanolamides of lauric acid (long chain alkanolamide).

Wash wipes as described above sustain the release of detergent over a sufficient number of rinse cycles to wash an entire car with just one wipe. Of course, the wash wipes of this invention also have other uses for cleaning a wide variety of different surfaces.

EXAMPLES

EXAMPLE 1

A detergent solution, to be applied to the polyolefin web and dried, was prepared containing the following ingredients: 50.50 grams water; 34.40 grams BioTerge AS-40 (sodium salt of $C_{14}$–$C_{16}$ olefin sulfonates (38–42% solids from Stepan Chemical); 5.20 grams Maprofix ES-2 (sodium salt of 2 moles ethoxylated lauryl sulfate (29–31% solids) from Onyx Chemical); and 9.90 grams Clindrol 100L (a mixture of diethanolamides of lauric acid having a 1:1 mole ratio of diethanolamide to lauric acid (100% solids) from Clintwood Chemical). To prepare the foregoing detergent solution, the water was placed into a beaker and heated to 50°–55° C. A stirrer was inserted such that a vortex was formed in the water. The BioTerge AS-40 was added and mixed until fully dispersed. The Maprofix ES-2 and Clindrol 100L were added in succession, fully dispersing the Maprofix ES-2 before the addition of the Clindrol 100L. The batch was cooled to ambient temperature (approximately 25° C.). The resulting mixture was a clear straw colored liquid with a pH of 9.2–11.1, viscosity of 2000–3600 cps and a solids (active detergent) content in the range of 23.6–25.5%. The primary detergent/flash foaming agent mole ratio was 10:1 and the detergent/long chain alkanolamide mole ratio was 4:1.

The detergent composition solution described above was saturated into a polypropylene meltblown base sheet having a basis weight of 82 grams per square meter and dried so that the add-on amount of detergent solids was 60% of the dry weight of the base sheet. The resulting wash wipe was used to wash a full-sized automobile, including the whitewalls, using a single 19"×19" sheet. In use, due to the affinity of the detergent composition for the base sheet, the detergent composition was slowly released, providing a time release of cleansing foam that rinsed easily.

EXAMPLE 2

A detergent solution was prepared as described in Example 1 with the following formula: 51.80 grams water; 35.90 grams Calsoft L-40 (sodium salt of dodecylbenzene sulfonate (Pilot Chemical)); 12.70 grams Standapol EA-2 (ammonium salt of 2 mole ethoxylated lauryl alcohol sulfate (Henkel Chemical)); and 9.60 grams Clindrol 100 L. The resulting detergent composition had 25% solids, a primary detergent/flash foaming agent mole ratio of 20:1, and a detergent/long chain alkanolamide mole ratio of 4:1.

EXAMPLE 3.

A detergent solution was prepared as described in Example 1 with the following solution: 35.40 grams water; 40.00 grams Standapol WAQ Special (sodium salt of lauryl sulfate (30% solids) from Henkel Chemical); 9.00 grams Standapol EA-2; and 14.60 grams Clindrol 100 CG (a mixture of diethanolamides of coconut acid having a 1:1 mole ratio of diethanolamide to coconut acid (100% solids) from Clintwood Chemical). The resulting detergent composition had 25% solids, a primary detergent/flash foaming agent mole ratio of 4:1, and a detergent/long chain alkanolamide mole ratio of 3:1.

EXAMPLE 4

A preferred detergent solution was prepared as described in Example 1 with the following solution: 53.30 grams water; 34.40 grams BioTerge AS-40; 2.30 grams Steol CS 460 (sodium salt of 3–4 mole ethoxylated lauryl alcohol sulfate (60% solids) from Stepan Chemical); and 9.90 grams Clindrol 100 L. The resulting detergent composition had 25% solids, a primary detergent/flash foaming agent mole ratio of 10:1, and a detergent/long chain alkanolamide mole ratio of 4:1.

EXAMPLE 5

A detergent solution was prepared as described in Example 1 with the following solution: 60.40 grams water; 17.20 grams BioTerge AS-40; 2.60 grams Standapol EA-2; and 19.8 grams Clindrol 100 L. The resulting detergent composition had 25% solids, a primary detergent/flash foaming agent mole ratio of 10:1, and a detergent/long chain alkanolamide mole ratio of 2:1.

EXAMPLE 6

A detergent solution was prepared as described in Example 1 with the following solution: 53.80 grams water; 33.40 grams Calsoft L-40; 5.50 grams Standapol ES-2 (sodium salt of 2 mole ethoxylated lauryl alcohol sulfate (Henkel Chemical)); and 7.30 grams Clindrol 100 CG. The resulting detergent composition had 25% solids, a primary detergent/flash foaming agent mole ratio of 8:1, and a detergent/long chain alkanolamide mole ratio of 6:1.

EXAMPLE 7

A detergent solution was prepared as described in Example 1 with the following solution: 50.50 grams water; 19.80 grams BioTerge AS-40; 19.80 grams Standapol EA-2; and 7.70 grams Clindrol 100 CG. The resulting detergent composition had 25% solids, a primary detergent/flash foaming agent mole ratio of 1:1, and a detergent/long chain alkanolamide ratio of 6:1.

All of the detergent solutions described in Examples 1–7 were added to polypropylene meltblown webs, as described in Example 1, at solids add-on levels of from about 20 to about 100 weight percent based on the dry weight of the polyolefin base web. All of the resulting wash wipes exhibited sustained detergent release.

EXAMPLE 8

In order to illustrate the sustained detergent release of the products of this invention, a Foaming Test was devised. In this test, a wash wipe as described in Example 4 was compared to a prior art product which comprised a cellulose/rayon base sheet saturated with a detergent (sodium dodecyl benzenesulfonate) at an add-on level of about 15 weight percent based on the weight of the dry base sheet. Both products were tested as follows:

A 1.0 gram swatch was cut from the sample detergent impregnated wipe to be tested. The swatch was immersed in 50 ml. of deionized water for one minute and removed. The deionized water was placed into a clean, rinsed 4 oz. capped flint glass bottle. The bottle was shaken vigorously for about 60 seconds. The shaking was stopped and the presence or absence of foam was noted. (The presence of foam indicates the release of detergent.) This procedure was repeated until no foam resulted from the immersion of the swatch. Each immersion was in a fresh sample of deionized water. The results are set forth in the Table below, wherein a "+" indicates foam observed, "0" indicates slight foam observed, and "—" means no foam observed. Two samples of each product were tested.

TABLE

| | (Foaming Test) Number of Cycles | | | | | | | | | |
|---|---|---|---|---|---|---|---|---|---|---|
| | 1 | 2 | 3 | 4 | 5 | 6 | 7 | 8 | 9 | 10 |
| Prior Art | | | | | | | | | | |
| #1 | + | — | — | — | — | — | — | — | — | — |
| #2 | + | O | — | — | — | — | — | — | — | — |
| This Invention | | | | | | | | | | |
| #1 | + | + | + | + | + | + | + | + | + | 0 |
| #2 | + | + | + | + | + | + | + | + | 0 | — |

The results illustrate that the prior art product released the detergent very quickly (2cycles) whereas the product of this invention released detergent over 9–10 cycles. In order to wash a full-sized car, it is believed that a product must release foam over at least 6–8 cycles of the Foaming Test.

It will be appreciated that the foregoing examples, shown for purposes of illustration, are not to be construed as limiting the scope of the invention.

We claim:

1. A wash wipe comprising a meltblown polyolefin web and a water-soluble detergent composition, said detergent composition comprising a primary detergent, a flash foaming agent, and a long chain alkanolamide, said primary detergent being selected from the group consisting of fatty alcohol sulfates of the formula $CH_3(CH_2)_nCH_2OSO_3$—X or alkyl aryl sulfonates of the formula

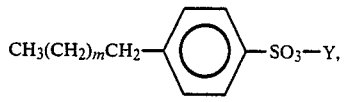

wherein "n" is an integer of from 7 to 18, "m" is an integer of from 8 to 10, "X" is selected from the group consisting of $NH_4$, Na, $HN(CH_2CH_2OH)_3$, $HNH(CH_2CH_2OH)_2$, or $HNH_2CH_2CH_2OH$, and "Y" is selected from the group consisting of $NH_4$, NA, $HN(CH_2CH_2OH)_3$, or $HNH(CH_2CH_2OH)_2$;

said flash foaming agent being an ethoxylated fatty alcohol sulfate of the formula $CH_3(CH_2)_n(OCH_2CH_2)_yOSO_3-X$ wherein "n" is an integer of from 7 to 18, "y" is an integer of from 1 to 14, and "X" is selected from the group consisting of $NH_4$, Na, $HN(CH_2CH_2OH)_3$, or $HNH(CH_2CH_2OH)_2$, or $HNH_2CH_2CH_2OH$;

said long chain alkano the formula;

$$CH_3(CH_2)_nC(=O)-X$$

or $$CH_3(CH_2)_7CH=CH(CH_2)_7C(=O)-X$$

wherein "n" is an integer of from 10 to 16 and "X" is selected from the group consisting of $N(CH_2CH_2OH)_2$, $NHCH_2CH_2OH$, and $NHCH_2CH(CH_3)OH$, wherein said wash wipe releases the detergent composition over a sustained period of time sufficient to wash a full-sized car.

2. The wipe of claim 1 wherein the long chain alkanolamide is selected from the group consisting of diethanolamides of lauric acid, monoisopropanolamides of oleic acid, diethanolamides of oleic acid, monoethanolamides of coconut acid, and diethanolamides of coconut acid.

3. The wipe of claim 1 wherein the polyolefin web is meltblown polyproyplene.

4. The wipe of claim 1 wherein the amount of the detergent composition solids is from about 20 to about 100 weight percent of the dry weight of the polyolefin web.

5. The wipe of claim 4 wherein the amount of the detergent composition solids is from about 40 to about 80 weight percent.

6. The wipe of claim 5 wherein the amount of detergent composition solids is about 60 weight percent.

7. The wipe of claim 4 wherein the mole ratio of primary detergent to flash foaming agent is from about 20:1 to about 1:1.

8. The wipe of claim 4 wherein the mole ratio of detergent to long chain alkanolamide is from about 12:1 to about 8:1.

9. The wipe of claim 4 wherein the mole ratio of detergent to long chain alkanolamide is from about 10:1 to about 1:1.

10. The wipe of claim 4 wherein the mole ratio of detergent to long chain alkanolamide is from about 6:1 to about 2:1.

11. A wash wipe comprising a polypropylene meltblown web having a basis weight of about 80 grams per square meter and a water-soluble detergent composition, said detergent composition comprising about 55 weight percent of the sodium salt of $C_{14}$–$C_{16}$ olefin sulfonates, about 5 weight percent of the sodium salt of ethoxylated lauryl alcohol sulfate, and about 40 weight percent diethanolamides of lauric acid.

* * * * *

UNITED STATES PATENT AND TRADEMARK OFFICE

CERTIFICATE OF CORRECTION

PATENT NO. : 4,735,739

DATED : April 5, 1988

INVENTOR(S) : David T. Floyd and Gary L. Shanklin

It is certified that error appears in the above-identified patent and that said Letters Patent is hereby corrected as shown below:

Claim 1, Column 6, line 18, delete the word "alkano" and substitute therefor --alkanolamide having--.

Signed and Sealed this

Fifteenth Day of May, 1990

*Attest:*

HARRY F. MANBECK, JR.

*Attesting Officer*

*Commissioner of Patents and Trademarks*